US006140299A

United States Patent [19]

Eriksson

[11] Patent Number: 6,140,299

[45] Date of Patent: Oct. 31, 2000

[54] CLEANING AGENT

[76] Inventor: Jan-Olof Eriksson, Midsommarstigen 23, SE-931 52 Skelleftea, Sweden

[21] Appl. No.: 09/381,473

[22] PCT Filed: Feb. 19, 1998

[86] PCT No.: PCT/SE98/00295

§ 371 Date: Sep. 21, 1999

§ 102(e) Date: Sep. 21, 1999

[87] PCT Pub. No.: WO98/42812

PCT Pub. Date: Oct. 1, 1998

[30] Foreign Application Priority Data

Mar. 21, 1997 [SE] Sweden ..... 9701042

[51] Int. Cl.[7] ..... C11D 3/00; C11D 17/00

[52] U.S. Cl. ..... 510/376; 510/367; 510/372; 510/374; 510/375; 510/446

[58] Field of Search ..... 510/367, 372, 510/374, 375, 376, 446

[56] References Cited

U.S. PATENT DOCUMENTS

| | | | |
|---|---|---|---|
| 2,738,293 | 3/1956 | Spence | 134/3 |
| 4,060,494 | 11/1977 | Schoenholz et al. | 252/105 |

FOREIGN PATENT DOCUMENTS

| | | |
|---|---|---|
| 1 355 855 | 6/1974 | United Kingdom . |
| 1355855 | 6/1974 | United Kingdom . |
| 2 112 428 | 7/1983 | United Kingdom . |
| 2112428 | 7/1983 | United Kingdom . |
| WO96/14381 | 5/1996 | WIPO . |

*Primary Examiner*—Yogendra Gupta
*Assistant Examiner*—John M Petruncio
*Attorney, Agent, or Firm*—Young & Thompson

[57] ABSTRACT

A cleaning agent characterized in that it is essentially free from tensides and that it is mainly composed of one or more alkali percarbonates or alkali earth metal percarbonates. The agent is preferably made up in the form of a tablet for an aqueous solution, and is principally composed of percarbonate in the form of sodium percarbonate.

10 Claims, No Drawings

CLEANING AGENT

CROSS REFERENCE TO RELATED APPLICATION

This application is the 35 USC 371 National Stage of International application PCT/SE98/00295 filed on Feb. 19, 1998, which designated the United States of America.

FIELD OF THE INVENTION

The present invention concerns a new cleaning agent with improved attributes. In particular, the invention concerns a new cleaning agent that is free from detergents, yet that nevertheless has eminently suitable cleaning qualities.

BACKGROUND OF THE INVENTION

Many different types of cleaning agent are known for use within different areas. Examples of such agents include dishwasher powders, washing machine powders, washing-up liquids, agents for washing by hand, general all-purpose cleaners and degreasing agents. Such agents can be made up in a variety of different ways, for example, as powders, liquids or in dosed units such as tablets. A large number of cleaning agents of different types is known from publications.

A common factor of practically all previously known cleaning agents is that they contain tensides (surfactants) of anionic, cationic and/or non-ionic types as active washing and cleaning substances. Tensides constitute a significant component of known cleaning agents and are responsible for the overwhelming part of the cleaning effect. Their amphiphilic molecules with a hydrophilic and a hydrophobic part bind to the particles of dirt and cause them to be suspended in the aqueous phase. This is well known to a skilled person in this area.

The use of tensides is, however, not without objections. From an environmental standpoint especially, it can be objected that the overwhelming proportion of tensides pass out in the waste water once washing has been completed and thereafter increase the load on waste water purification plants or on the watercourse. Many tensides are also difficult to break down by biological means and cause a significant increase in the oxygen consumption in purification plants or the watercourse. Such reasons have led to a greater desire to minimise the use of tensides in washing and cleaning agents, and the increased environmental awareness has made such aspirations even more noticeable.

SUMMARY OF THE INVENTION

By means of the present invention, the drawbacks mentioned above are to a large extent removed and users are provided with a washing or cleaning agent that is free from tensides and that has good washing and cleaning qualities. According to the invention, the washing and cleaning agents include active washing and cleaning components composed of one or more alkali or alkali earth metal percarbonates, and are essentially free from tensides. Preferably, the main component of the cleaning agent should consist of one or more of the said percarbonates, and principally of sodium percarbonate.

In one suitable embodiment, the cleaning agent is composed of an aqueous solution that can include currently available auxiliary agents that contribute to the cleaning effect, such as active washing enzymes, complex-formers and/or alkali. Such a ready-to-use aqueous solution can suitably contain about 1 g of percarbonate per liter of water.

In another suitable embodiment, the cleaning agent is composed in tablet form, which can preferably contain 1–2 g percarbonate. The tablet can also include auxiliary agents of a type currently available for tablets, such as binding agents, lubricants and/or disintegration agents.

It has been shown that the use of cleaning agents according to the invention containing only percarbonate, particularly sodium percarbonate, as the active agent can easily dissolve grease and dirt and suspend this in solution without the need for the presence of tensides. It has also been shown that in the absence of tensides, the amount of chemicals required to achieve a good cleaning effect can be reduced dramatically. The otherwise normal dosage has been able to be reduced by up to 80%. This gives the agent according to the invention a significant advantage.

It is known that percarbonate gives rise to hydrogen peroxide in aqueous solutions and that this then breaks down to water and oxygen in an active oxidising form. Without being bound by any special theory, one can assume that the hydrogen peroxide splits and oxidises the double bonds in the fat molecules so that the grease breaks down to water soluble or water dispersible compounds.

Experiments to dissolve sodium percarbonate in water have shown that about half of the percarbonate is broken down to hydrogen peroxide within 10 minutes at a temperature of 60° C. The time for this breakdown can be shortened by the use of accelerators, by which a stronger cleaning effect can thus be achieved in a shorter time. Such accelerators can be composed of other peroxide compounds, especially persulphonates and permanganates, preferably of alkali metals, especially sodium, calcium or ammonium. It has been shown that the use of such an accelerator in quantities of up to 10 mg per g percarbonate (1 percent by weight), essentially 100% of the percarbonate is broken down within 10 minutes in water at 60° C.

The use of such accelerators thus also constitutes a preferred embodiment of the invention. The use of accelerators results in faster dissolving and a quicker breakdown of the percarbonate, and thus gives a stronger cleaning effect within a shorter time. This is of particular importance for dishwashers and washing machines since shorter washing cycles can be set to give the same cleaning effect. For a quick breakdown to be achieved, the temperature should not be lower than 50° C. This requirement also means that the embodiment with accelerators is best suited to dishwashers and washing machines.

The use of peroxide compounds such as percarbonate is also mentioned in previous documents, for example, GB-A-2 112 428. GB-A-1 355 855, WO 95/13353 and WO 95/27774. However, all of these cases concern compositions for bleaching agents that contain different catalysts or activators for the breakdown of peroxide compounds. The issue at stake the whole time is the use of peroxide compounds together with significant amounts of tensides as the active washing agent, and it is neither stated nor implied that percarbonate itself in low concentrations exerts any washing effect. Only the bleaching effect is emphasized in these previously known documents.

Swedish application 9600663-0 describes the use of sodium percarbonate for controlling micro-organisms, especially hard to control forms such as mucous slime bacteria, yeast fungi and spores. This document does not mention or even imply that percarbonate can have a good cleaning effect against dirt, and a person skilled in this area receives no guidance to the present invention.

Previous attempts have been made to make up a cleaning agent containing sodium percarbonate in the form of an effervescent tablet to achieve rapid dissolving. The effervescent effect is obtained by the tablet containing an acid, such as citric acid, that in water reacts with carbonate to form carbon dioxide. However, this embodiment was shown to have a reduced cleaning effect. When the tablet dissolved in the water, the acid reacted with the percarbonate so that the hydrogen peroxide was formed and immediately broken down to water and oxygen, which, in this form, did not have any great cleaning effect. Surprisingly, it was later shown that if the acid was excluded, the cleaning effect increased greatly, and that by this means, the dose could be reduced by up to 50% compared with the effervescent tablet form.

The alkali percarbonates or the alkali earth metal percarbonates used according to the invention are preferably constituted of alkali metal percarbonates, and then principally of sodium percarbonate. Even other percarbonates according to the invention, such as the potassium or the ammonium salt, are technically possible to use, but are less advantageous for reasons of cost.

Percarbonates have a low toxicity and can be considered not to be harmful in small oral doses. In addition, they do not pose any great environmental threat when disposed of via drains. The active acid not used up during the cleaning process passes out into the waste water purification plant and the watercourse, where it can, in fact, even be considered to have a beneficial effect.

As stated previously, the characteristic feature of the cleaning agent according to the invention is that it is free from tensides. This means that the agent contains at the most 5 percent by weight of tensides, and ideally does not contain any demonstrable amounts of tensides at all. Tests have shown that quantities of tensides up to 5 percent by weight can, in fact, have a somewhat detrimental effect on the cleaning.

DETAILED DESCRIPTION OF THE INVENTION

The cleaning agent according to the invention can be used for a number of domestic and industrial applications. As such, it can be used as an agent in dishwashers, when a dose of 500–1500 mg sodium percarbonate is suitable for a normal sized dishwasher. The percarbonate solution for washing suitably has a PH within the interval 10.3 to 10.5. When the agent is used in a washing machine, a suitable dose is about 1000–2000 mg, depending to some extent on the size of the machine. When the agent is to be used as a general all-purpose cleaner, a suitable dose is about 200–300 mg per 5 liters of water, and when used for washing by hand, a suitable dose is about 500 mg per 5 liters of water.

The cleaning agent according to the invention can even be used for degreasing and cleaning in industry, for example, within the food industry and large scale catering. In such cases, a dose of about 1 g per liter of water is suitable for ready-to-use solution.

As only small amounts of percarbonate are needed to achieve a good cleaning effect, the cleaning agent according to the invention can be suitably made up in the form of tablets, which constitute an easy-to-handle format and give an accurately measured dose. Such a tablet suitably contains 1–2 g percarbonate, principally sodium percarbonate, plus suitable small amounts of conventional auxiliary agents, such as binding agents and lubricants, that help during the manufacture of the tablet. Such auxiliary agents are well known to a skilled person in this area, who can easily select what to include. In one preferred embodiment, the tablet also includes disintegration and breakage agents to speed up the breakdown of the tablet in water. It is more advantageous to use a disintegration agent rather than make up the tablet as an effervescent tablet, as the disintegration agent is chemically inert and does not cause the breakdown of the percarbonate. Such disintegration agents are well known within the pharmaceutical industry and are often composed of cellulose derivatives that swell in water. A couple of them are known under the tradenames Expo-Tab® and Ac-Di-Sol®. Suitable amounts of these said auxiliary agents can easily be determined by a skilled person within this area on the basis of experience or through simple routine testing.

Such a tablet according to the invention weights about 2 g and has a dissolving time in water of about 10 seconds. This can be compared with a previously known and commercially available tablet form of an agent for dishwasher ("FINISH") that contains a significant amount of tensides. This tablet weighs 18 g and has a dissolving time in water of about 10 minutes. In comparison with this known preparation, the agent according to the invention is advantageous since a tablet that rapidly dissolves quickly gives an effective concentration of cleaning agent during the course of the cleaning.

For use within industry, it can be appropriate to supply the cleaning agent according to the invention in the form of an aqueous solution. Such a solution can also include active washing enzymes to dissolve protein-based stains, and a complex-former, for example, a salt of EDTA or NTA, to bind metal ions. In addition, the solution can suitably contain alkali to provide stability. Suitable auxiliary agents and quantities of these can easily be chosen by a person skilled in this area on the basis of experience or through simple routine testing. A concentrated solution of the cleaning agent according to the invention for industrial use suitably has a pH within the interval 12 to 12.5. The pH value desired can be reached by the addition of alkali such as NaOH, $Na_2CO_3$ and similar. Usually, an addition of alkali of about 0.5–1% (w/v) is required.

Active washing enzymes and/or complex-formers can naturally also be included in the cleaning agent according to the invention when this is made up in tablet form.

In a comparison of dishwashing and cleaning tests, it has been shown that the cleaning agent according to the invention produces a result at least as good as previously known washing and cleaning agents that contain tensides. When the small amounts required by the cleaning agent according to the invention are borne in mind, and that the use of tensides has been eliminated, this must be considered to be both a technical and an environmental success within cleaning technology.

The invention is made clearer by the following example of an embodiment.

EXAMPLE

The cleaning agent according to the invention in the form of tablets and with different compositions was tested during normal dish washing in a Cylinda 770 dishwasher for 6 place settings under standard conditions. For each phase of the washing cycle, the dishwasher uses about 2.9 liters of water and about 14.5 liters of water were used in total. The dishwashing program was set for a normal wash at 55° C., except for one test, when the temperature was 65° C. Table 1 shows the test results obtained. The compositions of the cleaning agents used are given in table 2.

TABLE 1

| Dishwashing tablet, weight | Crockery % clean | Glass % clean | Cutlery % clean | Total % clean |
|---|---|---|---|---|
| No. 1, 2 g | 43.5 | 88.9 | 49.4 | 50.0 |
| No. 2, 2 g | 35.9 | 83.3 | 46.7 | 44.7 |
| No. 298, 2 g | 49.0 | 75.0 | 54.4 | 53.6 |
| No. 299, 1 g | 35.4 | 77.8 | 47.2 | 44.2 |
| No. 1, double-dose | 50.0 | 83.3 | 66.7 | 60.1 |
| No. 299, double-dose | 65.2 | 91.7 | 55.0 | 63.0 |
| No. 1, double-dose, 65° C. | 60.6 | 91.7 | 63.3 | 64.5 |
| Sun Micro 5 + 10 g | 66.7 | 83.3 | 60.0 | 65.2 |

TABLE 2

The composition of the cleaning agents in mg per tablet

| Tablet no. | 1 | 2 | 298 | 299 |
|---|---|---|---|---|
| Na percarbonate | 1400 | 1400 | 1400 | 700 |
| Enzyme | 180 | 180 | 180 | 180 |
| $KMnO_4$ | — | — | 10 | 5 |
| Tenside | — | 100 | — | — |

The remainder of the normal weight of the tablet comprised current inert auxiliary agents that aid the manufacture of tablets, such as binding agents, disintegration agents, stabilisers and the like.

COMMENTS

The enzyme used comprised a current, commercially available active washing, protein-dissolving enzyme. The tenside used comprised a current tenside for use in dishwashing agents. The agent "Sun Micro" comprised a commercially available dishwashing agent in powder form. It is divided into two doses: one of 5 g for the pre-wash and one of 10 g for the final wash. It includes a significant proportion of tensides.

DISCUSSION

From the results in the table, it is evident that tablet no. 1 gave a better result than tablet no. 2, which has the same composition, but that also includes tensides. Tablet no. 298 gave an even better result. This did not contain tenside but did include a small quantity of potassium permanganate as accelerator. With this composition, even a half dose of sodium percarbonate (tablet no. 299) gave an acceptable result. A double-dose of tablet 299, which thus contains twice the mount of enzyme compared with the others, gave by far the best result. Similar results were obtained with tablet no. 1 when the temperature was raised by 10° C. This shows that accelerators contribute to starting the cleaning effect sooner at lower temperatures.

It is also evident that the commercially available dishwashing agent "Sun Micro" did not give a significantly better washing result, despite a considerably larger quantity of active cleaning agents, including a significant amount of tensides.

The present description has principally referred to the use of sodium percarbonate as the active cleaning agent, and to its use in specific preparations and embodiments. It is, however, obvious to a skilled person within this area that even other percarbonates and other preparations and embodiments within the scope of the following claims are equally applicable and that they will give similarly advantageous results.

What is claimed is:

1. A cleaning composition consisting of one or more alkali percarbonates or alkali earth metal percarbonates as the single effective cleaning agent, said composition being essentially free from tensides and acid, and formulated as an aqueous solution optionally comprising at least one of an active washing enzyme, a complex former and an alkali; or formulated as a tablet optionally comprising at least one of a disintegration agent and an accelerator.

2. The cleaning composition according to claim 1, wherein the percarbonate comprises sodium percarbonate.

3. The cleaning composition according to claim 1, wherein the composition is made up in the form of an aqueous solution.

4. The cleaning composition according to claim 3, wherein the aqueous solution also contains at least one of active washing enzymes, complex-formers and alkali.

5. The cleaning composition according to claim 3, wherein the composition contains 1 g percarbonate per liter of aqueous ready-to-use solution.

6. The cleaning composition according to claim 1, wherein the composition is made up in the form of a tablet.

7. The cleaning composition according to claim 6, wherein the tablet contains 1–2 g percarbonate.

8. The cleaning composition according to claim 6, wherein the tablet also contains a disintegration agent.

9. The cleaning composition according to claim 6, wherein the tablet also contains an accelerator comprising at least one of an alkali metal persulphonate and an alkali metal permanganate.

10. The cleaning composition according to claim 9, wherein the accelerator is included in an amount up to about 10 mg per g percarbonate.

* * * * *